United States Patent [19]

Deconinck

[11] Patent Number: 4,521,054

[45] Date of Patent: Jun. 4, 1985

[54] CHAISE LOUNGE

[75] Inventor: Didier Deconinck, Seysinnet Pariset, France

[73] Assignee: Allibert S.A., Grenoble, France

[21] Appl. No.: 504,250

[22] Filed: Jun. 14, 1983

[30] Foreign Application Priority Data

Jun. 22, 1982 [FR] France ..... 82 11323

[51] Int. Cl.[3] ..... A47C 1/026

[52] U.S. Cl. ..... 297/357; 297/21

[58] Field of Search ..... 297/21, 357, 377

[56] References Cited

U.S. PATENT DOCUMENTS

| | | | |
|---|---|---|---|
| 715,483 | 12/1902 | Kelley | 297/357 X |
| 717,026 | 12/1902 | Ostendorf | 297/357 X |
| 1,294,378 | 2/1919 | Barnes | 297/357 X |
| 2,146,520 | 2/1939 | Zimtbaum | 297/357 |
| 2,614,612 | 10/1952 | Wogoman | 297/377 X |
| 3,385,632 | 5/1968 | Scelzi | 297/357 |

FOREIGN PATENT DOCUMENTS

| | | | |
|---|---|---|---|
| 328563 | 4/1930 | United Kingdom | 297/357 |

*Primary Examiner*—Francis K. Zugel
*Assistant Examiner*—Peter R. Brown
*Attorney, Agent, or Firm*—Karl F. Ross; Herbert Dubno

[57] ABSTRACT

A chaise lounge has a supporting unit whose longitudinal members are provided with rollers and are slotted to receive arms of a backrest which have pins selectively engageable in notches along these slots and whose free ends are engageable by abutments on the underside of the supporting unit to cantilever the backrest on the latter.

2 Claims, 7 Drawing Figures

FIG. 1
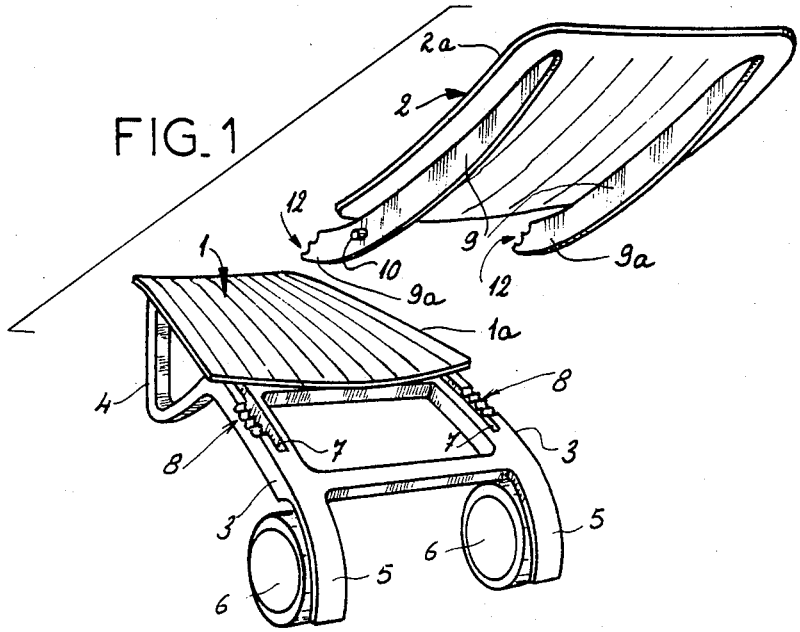
FIG. 2
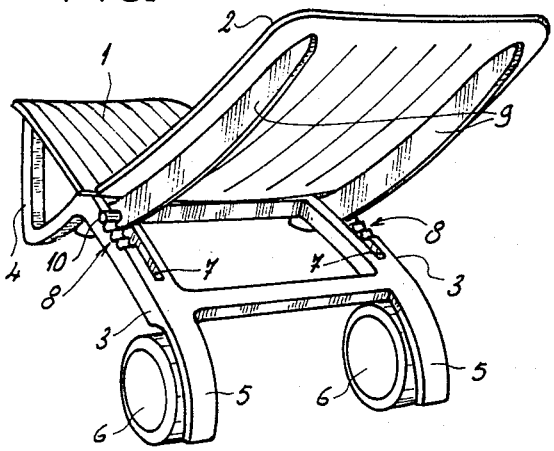
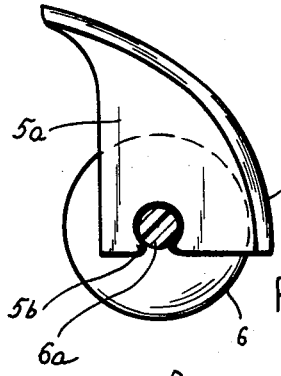
FIG. 7
FIG. 3
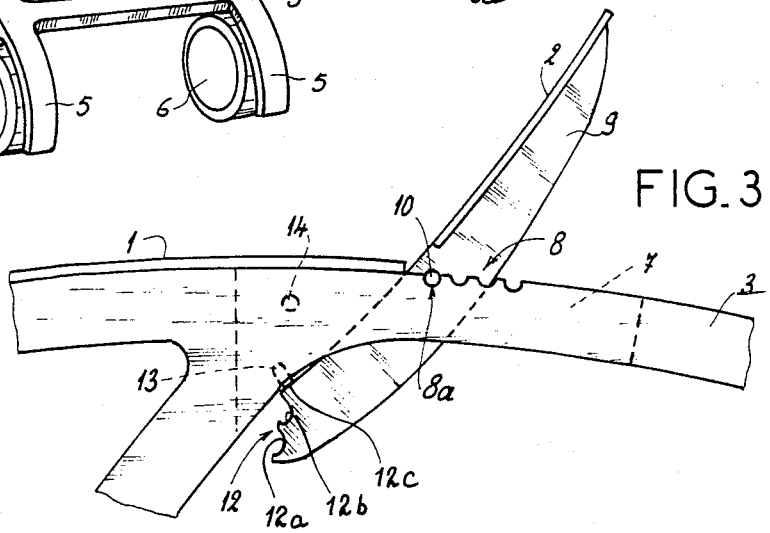

CHAISE LOUNGE

FIELD OF THE INVENTION

My present invention relates to a chaise lounge of the type in which the inclination of the back is adjustable with respect to the seating or torso-resting portion.

BACKGROUND OF THE INVENTION

While various types of chaise lounges have been developed heretofore, one particular kind has found widespread application as lawn, patio and terrace furniture. This type of chaise lounge generally comprises a framework or other structure forming the body-supporting portion of the article, this portion being elongated and provided with wheels at one end. A pair of handles or a similar means can be provided on the opposite end to permit the chaise lounge to be displaced on its wheels from place to place. An adjustable-inclination backrest is provided proximal to the end formed with the handle or handles, this backrest being pivotally mounted on the chassis and being settable into one of a selected group of inclinations vis-a-vis the body-resting area.

The chaise lounge of this type generally has been rather complex because of the large number of elements required to connect the backrest to the chassis or frame of the seating of body-supporting portion. For example, the articulation between the backrest and the frame could involve a plurality of pivots, guide slots in which the pivots could be shifted, one or more links articulated to one another, to the backrest and to the frame, various formations which interfit and cooperate allow the inclination of the backrest to be adjusted, etc.

Not only does this comparatively large number of coupling elements greatly contribute to the long assembly time for such a chaise lounge, but the parts generally are metallic pieces which are exposed for long periods of time to the environment and are subject to rusting or other oxidation processes if they are not periodically maintained or treated.

Because of the numerous coupling elements involved, the chaise lounge may be comparatively large which poses problems during periods of nonuse, e.g. when the chaise lounge must be stacked with other similar units or otherwise stored.

OBJECTS OF THE INVENTION

It is the principal object of the present invention to provide a chaise lounge which avoids these disadvantages.

Still another object of the invention is to provide an article of furniture with an adjustable back and wherein the coupling between the back and the seating element of the unit is greatly simplified by comparison with earlier systems.

Still another object of this invention is to provide an easily adjustable, simple, inexpensive and reliable articulation system between an adjustable inclination back of the seating unit of a chaise lounge whereby the entire article is made more compact for storage and more maintenance-free in use, even in corrosive environments than earlier structures for a similar purpose.

SUMMARY OF THE INVENTION

These objects and others which will become apparent hereinafter are attained in accordance with the present invention, in a chaise lounge or similar article of furniture, especially lawn, garden, patio or terrace furniture (outdoor furniture) which comprises an elongated body-supporting unit which is formed at one end with wheels and at the opposite end with handle means enabling the chaise lounge to be lifted at this latter end and drawn or pushed to change its position on the ground or on a floor. The frame is spanned by a surface on which the torso of the body can largely rest.

The supporting unit and a backrest which, according to the invention is used with the supporting unit, comprise at least one pair of interfitting formations pivotally mounting the backrest upon the supporting unit or frame, one of these formations defining a pivot for the backrest which swingably mounts the latter on the frame at an adjustable location substantially at the level of the supporting surface and locked forwardly of the center of gravity of the backrest, and another pair of formations on the frame and the backrest locked at the lower extremity of the backrest and serving as a brace enabling the upper portion of the backrest above the pivot to being cantilevered on the frame. These two pairs of formations will be referred to hereinafter as first and second pairs of formations and each of these pairs or either of these pairs of formations can be duplicated on the opposite longitudinal sides of the chaise lounge.

Because of the cantilever construction, the center of gravity of the backrest is located rearwardly and above the pivot so that the weight of the backrest serves to hold the second pair of formations in engagement and to lock the first pair of formations in position along the frame. Only when the force is applied to the upper portion of the backrest in the forward direction can either or both of the first and second pairs of formations be disengaged to allow readjustment of the angle of inclination of the backrest and/or removal thereof.

According to a feature of the invention, the frame of the support unit is formed with a pair of slots while the backrest has a pair of arms extending downwardly through these slots. Advantageously, at upper portions of these arms, a pair of laterally extending pins are provided which can selectively engage in respective upwardly open notches of a series of such notches forming crenellations along the frame members flanking the slots. One such pin and the associated row of crenellations or notches form the first pair of formations on one side of the chaise lounge while a duplicate of this first pair is provided in mirror-symmetrical relationship along the opposite longitudinal side of the chaise lounge.

The bottom end of each of these arms is notched or stepped for selective engagement with ledges, pins or other abutments disposed below the resting surface of the supporting unit and each arm end and the abutments engaged thereby can constitute a respective second pair of formations duplicated on both longitudinal sides of the chaise lounge.

Furthermore, the frame may be molded unitarily from a synthetic resin material and may have downwardly extending legs running rearwardly from the aforementioned slots and carrying the wheels, while the handles may be unitarily molded on the frame at the opposite end and the resting surface may be separately attached or integrally molded on the frame.

BRIEF DESCRIPTION OF THE DRAWING

The above and other objects, features and advantages of the present invention will become more readily apparent from the following description, reference being made to the accompanying drawing in which:

FIG. 1 is a somewhat exploded view in perspective from the rear, showing a chaise lounge according to the invention with the removable backrest about to be inserted into its operative position;

FIG. 2 is a rear-perspective view showing the backrest in one of its operative positions;

FIG. 3 is a side-elevational view of the region at which the backrest is pivotally mounted on the supporting unit showing the details of the formations on the left side of the chaise lounge, these formations being duplicated on the right side thereof;

FIG. 7 is a detail view showing the possible mode of connection of the wheels to the seating unit.

SPECIFIC DESCRIPTION

Figure 4:
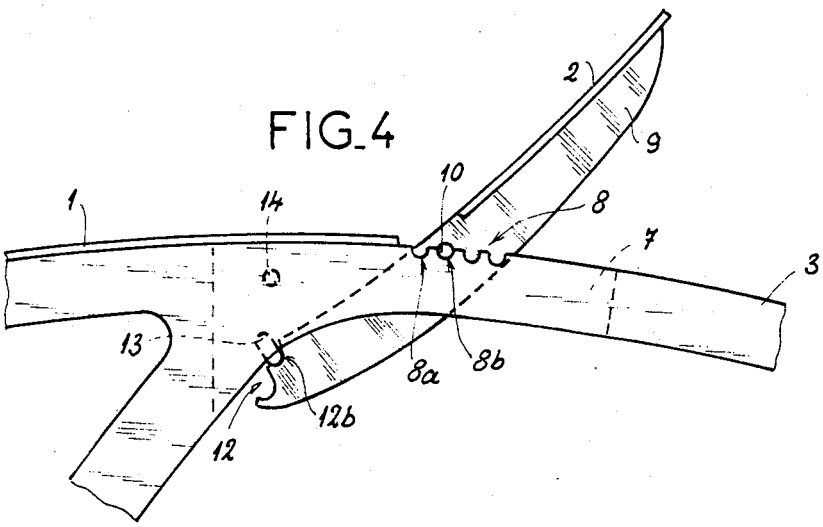
FIG. 4–6 are views similar to FIG. 3 but showing other positions of the backrest with respect to the seating unit.

The chaise lounge of the present invention comprises two essential elements, namely a supporting unit 1 and a backrest 2. Both may be integrally molded except for the wheel 6 described hereinafter and possibly the pins 10, from a synthetic resin, e.g. polystyrene, or a thermosetting resin reinforced with glass or other fibers.

The support unit comprises a seating or body supporting surface 1*a* on a frame having two longitudinal members along the opposite longitudinal sides of this elongated element, unitarily molded with two feet 4 in the form of bows which can also constitute handles enabling the seating unit to be lifted at its front end and moved by the wheels 6 which are journaled on a pair of downwardly extending legs 5 formed unitarily on the longitudinal members 3. The wheels 6 also serve with the feet 4 to support the unit 1 on the ground.

More particularly, each of the downwardly turned legs 5 can be provided with a web 5*a* having a slot 5*b* in which a shaft 6*a* is received and connects the two disk shaped halves of a wheel 6. (See FIG. 7.)

Each of the longitudinal members 3 is formed with a slot 7 in a vertical plane and laterally of the respective slot 7 along the upper surface of the longitudinal member, with a row of upwardly notches 8 for example, four in number, form a crenellation which can cooperate with an element receivable selectively in these notches for positioning the backrest along the longitudinal member and permitting adjustment of the inclination.

The backrest 2 is molded with two reinforcing ribs 9 extending downwardly at 9*a* as a pair of arms below the back supporting surface 2*a*. These ribs 9 are thus locked on the dorsal face of the member 2*a*.

The arms 9*a* are of a thickness such that they can fit freely within the slots 7 but without excessive play.

Each of the arms 9 has a lateral pin 10 adapted to be lodged selectively in one of the notches 8 of the respective crenellation of its longitudinal member 3. The pins 10 are disposed forwardly of the center of gravity of the backrest in all positions of the latter in which the pin 10 is engaged in a respective notch 8 and the lower end 12 of the arms 9*a* engage formations on the underside of the support unit 1.

The free ends of the arms 9*a* at 12 are thus provided with a pair of notches 12*a* and 12*b* selectively engageable with inwardly extending abutments 13 of the members 3 or with pins 14 extending inwardly above the abutments 13. The abutments 13 may be connected by a transverse strut and instead of the pins 14, a rod may span the frame.

The pin 10 and the respective notch 8 constitute formations of the first pair mentioned previously while the notches 12*a*, 12*b* and the abutments 13 and 14 constitute formations of the second pair. These two pairs of formations, duplicated on the opposite longitudinal sides of the chaise lounge, permit not only positioning of the backrest along the support unit, but also control of the inclination of the backrest.

FIGS. 3–6 show the various inclinations which can be given to the backrest.

In FIG. 3, for example, the backrest is shown in its most upright position, i.e. with minimal inclination and in this position each of the pins 10 rests in a frontmost notch 8*a* of the respective crenellation while the abutment 13 is engaged by free ends of the arms 9*a*.

By lifting the backrest slightly to withdraw the pins 10 from the notches 8*a*, the backrest can be moved rearwardly so that the pins engage in notches 8*b* with the notch 12*b* still engaged with the abutments 13 (FIG. 4). In this position, there is a greater rearward inclination of the backrest than in FIG. 3.

Figure 5:
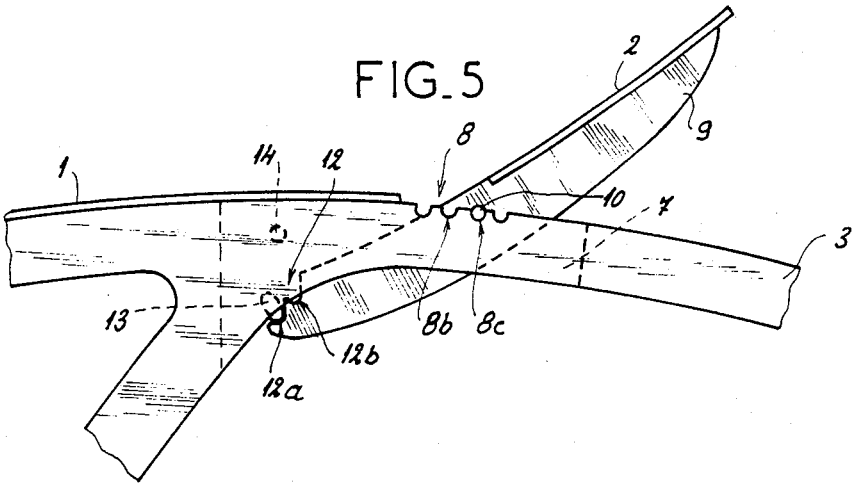
Figure 6:
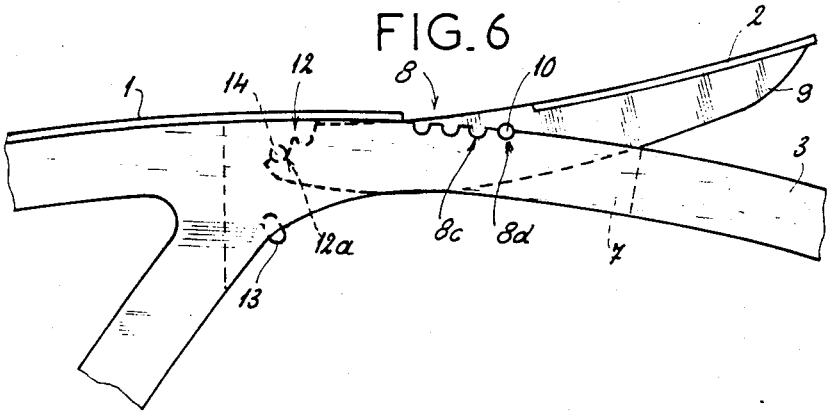

The inclination can be increased still further as in FIG. 5 where the pins 10 are engaged in the notches 8*c* and the notches 12*a* engage the abutment 13. Finally in FIG. 6 the backrest is in its maximum inclination, the pins 10 resting in the notches 8*d* while the notches 12*a* engage the pins 14. This, of course also represents the maximum extension of the chaise lounge and the seating surface 1*a* and the backrest surface 2*a* can be considered more or less continuous in defining a supine position for the user.

The switch from one position to another can be effected quickly and with the most simple of movements, since the cantilevered position of the backrest is maintained by its weight in FIGS. 3–6 and one need only tilt the backrest forwardly and upwardly to move the pins from a rear notch to a forward notch or lift the backrest to shift the pins 10 from a forward notch to a rearward notch and disengage the notches 12*a*, 12*b* from the abutments 13, 14. Since the backrest is not permanently connected to the seating unit, it can be lifted out of the slot 7 and simply placed upon the seating surface 1*a*, if desired, to facilitate storage.

I claim:

1. A chaise lounge comprising:

an elongated body-supporting unit formed at one end with a pair of wheels, at another end with handle means for displacement of said unit, and between said ends with a surface for supporting a body of a user; and an adjustable inclination backrest separable from and adapted to be mounted on said body-supporting unit, said backrest being provided with a body-engaging surface and a pair of arms projecting downwardly from the body-engaging surface, said unit having at least one opening adapted to receive said arms, and being formed on opposite sides of said unit adjacent said arms and said at least one opening with respective rows of upwardly open notches, each of said arms having a respective outwardly extended pin engageable in a selected notch in a respective one of said rows, said unit being formed below said surface of said unit with two abutments at different levels and said arms being provided at free ends thereof below said surface of said backrest with a plurality of formations in the form of notches selectively engageable with said abutments whereby the orientation of said backrest is established by selection of said notches and the engagement of the free ends of said arms with said abutments and said arms are withdrawable from said at least one opening freely upwardly to separate said backrest form said unit, said backrest being cantilevered on said unit upon the engagement of said free ends with one of said abutments and the resting of said pins in the selected notches, said body-supporting unit comprising a pair of molded synthetic resin longitudinal members along oppposite longitudinal sides thereof between said surface of said unit and said one end thereof, each of said members being formed with a respective longitudinally extending slot receiving a respective one of said arms and adjacent a respective row of said upwardly open notches, said slots defining said opening, each of said rows of upwardly open notches being located only along an outer edge of a respective one of said slots.

2. The chaise lounge defined in claim 1 wherein said backrest is molded with said arms unitarily from synthetic resin.

* * * * *